US009233536B2

(12) United States Patent
Tomizawa et al.

(10) Patent No.: US 9,233,536 B2
(45) Date of Patent: Jan. 12, 2016

(54) LIQUID EJECTION HEAD, LIQUID EJECTION APPARATUS, AND METHOD OF MANUFACTURING LIQUID EJECTION HEAD

(71) Applicant: CANON KABUSHIKI KAISHA, Tokyo (JP)

(72) Inventors: Keiji Tomizawa, Yokohama (JP); Takuma Kodoi, Kawasaki (JP); Takuya Iwano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/606,895

(22) Filed: Jan. 27, 2015

(65) Prior Publication Data

US 2015/0210077 A1 Jul. 30, 2015

(30) Foreign Application Priority Data

Jan. 28, 2014 (JP) ..... 2014-013138

(51) Int. Cl.
*B41J 2/175* (2006.01)
*B41J 2/14* (2006.01)
*B41J 2/16* (2006.01)

(52) U.S. Cl.
CPC ..... *B41J 2/14201* (2013.01); *B41J 2/1607* (2013.01)

(58) Field of Classification Search
CPC ..... B41J 2/17503; B41J 2/17526; B41J 2/17546; B41J 2/14024; B41J 2/14072; B41J 2002/14362; H05K 3/361; H05K 1/118
USPC ..... 347/50, 58, 87; 361/749; 439/67
See application file for complete search history.

(56) References Cited

U.S. PATENT DOCUMENTS 5,442,386 A * 8/1995 Childers et al. ..... 347/50
5,852,460 A * 12/1998 Schaeffer et al. ..... 347/87
7,862,157 B2 * 1/2011 Fukui et al. ..... 347/62

FOREIGN PATENT DOCUMENTS

JP 2007-320229 A 12/2007

* cited by examiner

*Primary Examiner* — Anh T.N. Vo
(74) *Attorney, Agent, or Firm* — Canon USA Inc. IP Division

(57) ABSTRACT

A liquid ejection head including:

a recording element substrate provided with an element;

an electric wiring substrate having a bent portion, a connecting portion provided on one side of the bent portion and connected with the recording element substrate, and an input portion provided on the other side of the bent portion; and a housing having a first surface, a second surface, a depression provided on the second surface, and a member separated from a bottom surface of the depression and extending into an opening of the depression, wherein part of the other side of the electric wiring substrate is disposed between the bottom surface of the depression and the member.

17 Claims, 9 Drawing Sheets

LIQUID EJECTION HEAD, LIQUID EJECTION APPARATUS, AND METHOD OF MANUFACTURING LIQUID EJECTION HEAD

BACKGROUND OF THE INVENTION

1. Field of the Invention

This disclosure relates to a liquid ejection head configured to eject a liquid, and a liquid ejection apparatus provided with the liquid ejection head. This disclosure also relates to a method of manufacturing the liquid ejection head.

2. Description of the Related Art

A liquid ejection head forms an image by ejecting liquid drops. Ejection of the liquid drops is achieved by heating liquid with an energy generating element provided with a heat generating resistance member and causing the liquid to undergo film boiling. Alternatively, there is a case where a piezoelectric element is used for ejection of the liquid drops, and there is also a case where a method of irradiating the liquid with an electromagnetic wave generated by a laser or the like is used. The liquid ejection head is mounted generally on a recording apparatus body. The liquid ejection head is controlled and driven by an electric signal supplied from the recording apparatus body, and forms an image. Therefore, in order to form an image with the liquid ejection head, electrical communication between the recording apparatus body and the liquid ejection head is required.

In order to realize the electrical communication, the liquid ejection head includes an electric wiring substrate that electrically connects the energy generating element and the recording apparatus body. The electric wiring substrate includes an electric signal input portion including a conductive contact pad, and the recording apparatus body includes a contact pin configured to be electrically connected to the contact pad. Contact between the contact pad and the contact pin enables the electrical communication. As disclosed in Japanese Patent Laid-Open No. 2007-320229, the electric wiring substrate is a flexible wiring substrate having a plurality of electric wiring lines arranged in a single layer, and the contact pad is provided directly on the flexible wiring substrate. In order to reduce the size of the electric signal input portion, there is also a case where a multilayer wiring substrate having a plurality of electric wiring lines arranged in multiple layers is connected to the flexible wiring substrate, and the contact pad is formed on the multilayer wiring substrate. In a manufacturing step of the liquid ejection head, the electric wiring substrate is bent along two surfaces of a housing of the liquid ejection head, and crimped at points the circumference of the electric signal input portion (at four points, for example).

Although a principal portion of the electric wiring substrate, specifically, a bent portion is formed of an easy-to-bend material such as that for a flexible wiring substrate, it is difficult to bend completely along the shape of the housing. Therefore, there is a case where floating occurs in the vicinity of the bent portion at the time of bending.

FIG. 11A and FIG. 11B are a side view and a front view of the liquid ejection head disclosed in Japanese Patent Laid-Open No. 2007-320229. In a liquid ejection head 1 disclosed in Japanese Patent Laid-Open No. 2007-320229, a housing 2 includes a first surface 2*a* positioned on the same side as an ejection port, a second surface 2*b* intersecting the first surface 2*a*, and a corner portion 2*c* formed by the first and second surfaces 2*a* and 2*b* intersecting each other.

An electric wiring substrate 3 includes a first portion 4 supported on the first surface 2*a*, a second portion 6 including a bent portion 5 bent at the corner portion 2*c*, and a third portion 7 supported on the second surface 2*b*. The third portion 7 corresponds to the electric signal input portion described above.

In this manner, when the electric wiring substrate 3 is supported by the housing 2, floating occurs in the vicinity of the bent portion 5 due to the bending rigidity of the electric wiring substrate 3. This tendency is notable in the electric wiring substrate 3 having a large area other than the electric signal input portion and the electric wiring substrate 3 having a large width. The floating of the electric wiring substrate 3 occurs not only at the time of manufacture, but also by heat after usage or a change with time. The floating in the vicinity of the bent portion 5 as described above causes an increase in the dimensions of the liquid ejection head 1, specifically, an increase in a dimension L illustrated in FIG. 11A.

In order to reduce a height of the floating, it is conceivable to fixedly crimp the electric wiring substrate 3 while pulling strongly. However, since the electric wiring substrate 3 is fixed in the state of being applied with a tensile force, a crimped portion of the electric wiring substrate 3 may be cracked, or other portions may wrinkle after the tensile force is released. From these reasons, the electric wiring substrate 3 is preferably supported on the housing 2 in the state of being tensed with an excessive length at the second portion 6, that is, in the state in which the second portion 6 sags.

SUMMARY OF THE INVENTION

In order to solve the above-described problem, there is provided a liquid ejection head including:

a recording element substrate provided with an element configured to generate energy used for ejecting liquid;

an electric wiring substrate having a bent portion, a connecting portion provided on one side of the bent portion and connected with the recording element substrate, and an input portion provided on the other side of the bent portion and configured to receive an input of a signal to be supplied to the recording element substrate; and a housing having a first surface configured to support one side of the electric wiring substrate, a second surface configured to support the other side of the electric wiring substrate, a depression provided on the second surface, and a member separated from a bottom surface of the depression and extending into an opening of the depression, wherein part of the other side of the electric wiring substrate is disposed between the bottom surface of the depression and the member.

Further features of the present invention will become apparent from the following description of exemplary embodiments with reference to the attached drawings.

DESCRIPTION OF THE EMBODIMENTS

Hereinafter, embodiments of this disclosure will be described with reference to the drawings.

First of all, a basic structure of a liquid ejection head of this embodiment will be described with reference to FIG. 1 to FIG. 4. In FIG. 1 to FIG. 4, a bent portion which will be described later is not illustrated.

Figure 1:
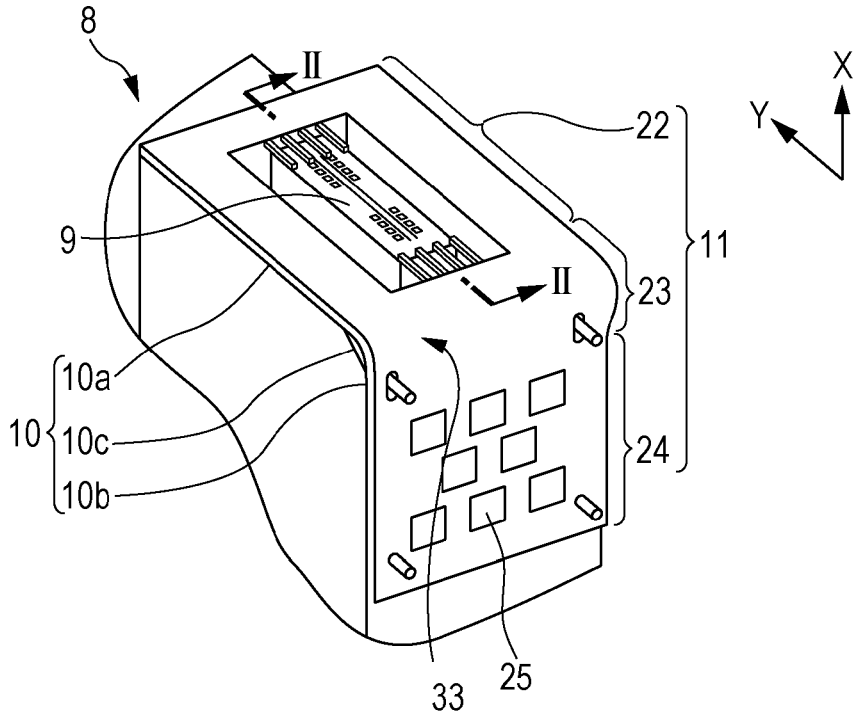
FIG. 1 is a partial perspective view of a liquid ejection head according to an embodiment of this disclosure.

FIG. 1 is a partial perspective view of the liquid ejection head according to the embodiment of this disclosure. As illustrated in FIG. 1, a liquid ejection head 8 of the embodiment includes an element substrate 9 configured to eject a liquid, a housing 10, and an electric wiring substrate 11 having flexibility.

Figure 2:
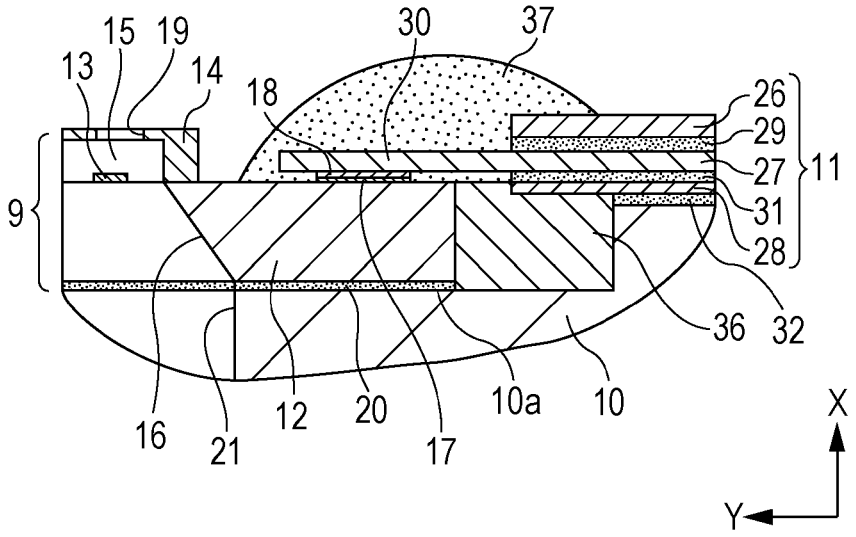
FIG. 2 is an enlarged cross-sectional view when the liquid ejection head is cut along a plane II-II illustrated in FIG. 1.

FIG. 2 is an enlarged cross-sectional view when the liquid ejection head 8 is cut along a plane II-II illustrated in FIG. 1. As illustrated in FIG. 2, the element substrate 9 includes a silicon-made substrate body 12, a plurality of energy generating elements 13 formed on one surface of the substrate body 12, and an ejection port forming member 14 fixed to the one surface. Examples of the energy generating elements 13 include a heat-resistant member.

A foaming chamber 15 is formed by the substrate body 12 and the ejection port forming member 14. A liquid supply port 16 having an elongated hole shape is formed at a center of the substrate body 12, and a liquid such as ink is supplied from the liquid supply port 16 of the substrate body 12 to the foaming chamber 15.

The plurality of energy generating elements 13 are arranged on both sides of the liquid supply port 16 substantially equidistantly. The substrate body 12 provided with the energy generating elements 13 is also referred to as a heater board.

The substrate body 12 is provided with a wiring line (not illustrated) for supplying electric power to the energy generating elements 13 laid thereon. The wiring line is connected to electrode pads 17 arranged at both ends of the substrate body 12. Bumps 18, which function as electrodes, are formed on the electrode pads 17.

An ejection port 19 communicating with the foaming chamber 15 is formed in the ejection port forming member 14. The liquid supplied to the foaming chamber 15 is ejected from the ejection port 19 upon reception of ejection energy from the energy generating element 13.

Referring to FIG. 1 and FIG. 2, the housing 10 includes a first surface 10*a*, a second surface 10*b* intersecting the first surface 10*a*, and a corner portion 10*c* formed by the first and second surfaces 10*a* and 10*b* intersecting each other, and the element substrate 9 is supported on the first surface 10*a*.

Specifically, an adhesive agent 20 is applied to the first surface 10*a*, and a surface opposite to the one surface to which the ejection port forming member 14 of the substrate body 12 is fixed is fixed to the first surface 10*a* via the adhesive agent 20. A liquid supply port 21 formed on the housing 10 communicates with the liquid supply port 16 of the element substrate 9.

The electric wiring substrate 11 includes a first portion 22 (also referred to as "electrically connecting portion") supported on the first surface 10*a*, a second portion 23 bent at the corner portion 10*c*, and a third portion 24 (also referred to as "contact portion") supported on the second surface 10*b*. The first portion 22 is electrically connected to the element substrate 9.

The third portion 24 includes a contact portion for receiving an electric signal from outside of the liquid ejection head 8. With contact of the contact portion 25 with a contact pin (not illustrated) provided on a main body of the liquid ejection apparatus, the electric wiring substrate 11 is allowed to receive drive power and an electric signal from the main body of the liquid ejection apparatus. The drive power and the electric signal are transmitted to the first portion 22 via the second portion 23.

For example, a flexible substrate is used as the electric wiring substrate 11. The electric wiring substrate 11 includes a base film 26, a copper foil 27 patterned on the base film 26, and a cover film 28.

The copper foil 27 is adhered to the base film 26 by using an adhesive agent 29. One end of the copper foil 27 is drawn from the base film 26, and the one end of the copper foil 27 functions as an electrode terminal 30 (also referred to as "lead wire"). The electrode terminal 30 is connected to the bumps 18 of the element substrate 9, so that the first portion 22 is electrically connected to the element substrate 9.

The cover film 28 covers portions of the copper foil 27 other than the electrode terminal 30. The cover film 28 is adhered to the copper foil 27 with an adhesive agent 31.

The first portion 22 is supported by the housing via an adhesive agent 32. The first portion 22 supported by the housing 10 extends from the second portion in a second direction Y which intersects a first direction X in which the liquid is ejected.

The third portion 24 is supported by the housing 10 in the state in which a first bent portion 33 is formed on the second portion 23. The second portion 23 is extended with an excess of length, and hence sags. Examples of the method of fixing the third portion 24 to the housing 10 include a method of hitting or clamping a claw or a projection with a tool (also referred to as "crimping").

The housing 10 is formed to bring the electrode terminal 30 and the bumps 18 into contact with each other with the electrode terminal 30 extending substantially straight.

Figure 3A:
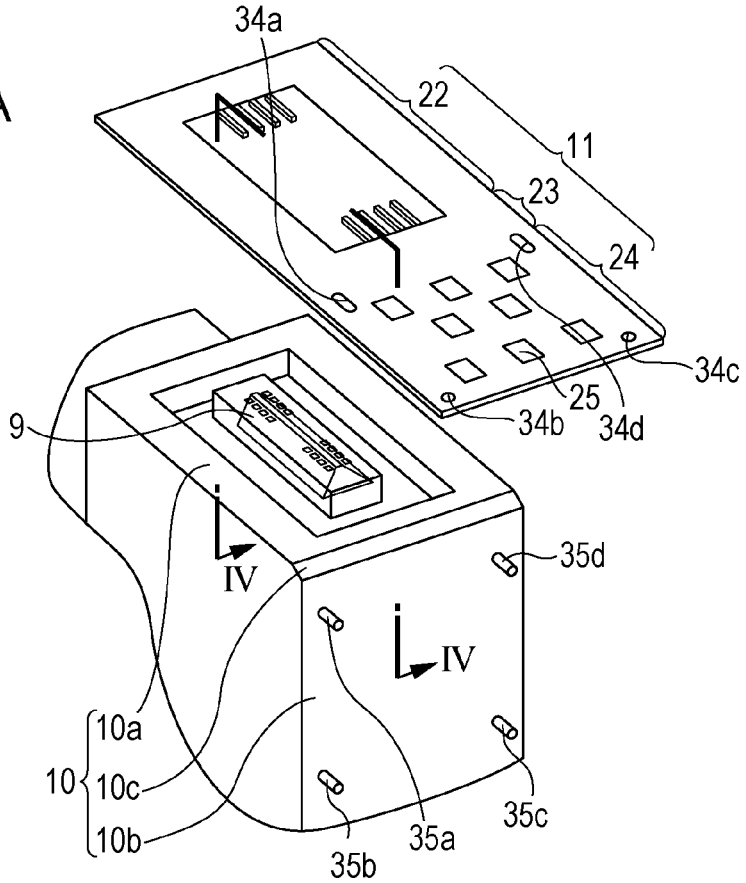
FIGS. 3A and 3B are partial perspective views for explaining a process for fixing an electric wiring substrate to a housing.
Figure 3B:
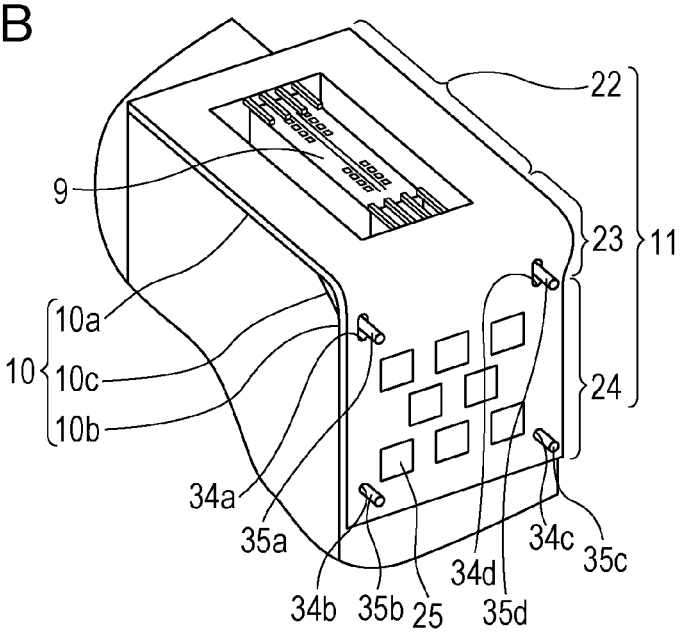
Figure 4:
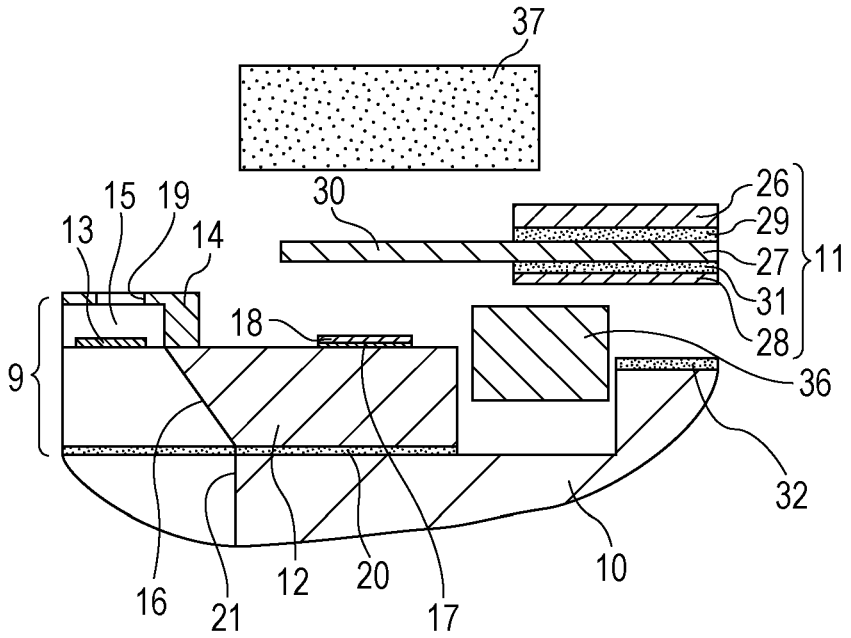
FIG. 4 is an enlarged cross-sectional view when the liquid ejection head is cut along a plane IV-IV illustrated in FIG. 3A.

Here, a method of manufacturing the liquid ejection head 8 will be described briefly with reference to FIGS. 3A and 3B and FIG. 4. FIGS. 3A and 3B are partial perspective views for explaining a process for fixing the electric wiring substrate 11 to the housing 10. FIG. 4 is an enlarged cross-sectional view when the element substrate 9, the housing 10, and the electric wiring substrate 11 are cut along a plane IV-IV illustrated in FIG. 3A.

An operator or the manufacturing apparatus prepares the housing 10 configured to support the element substrate 9 via the adhesive agent 20 (see FIG. 2), and the electric wiring substrate 11 which is not bent as illustrated in FIG. 3A. The third portion 24 of the electric wiring substrate 11 includes four holes 34*a* to 34*d*. The housing 10 includes four projections 35*a* to 35*d* formed corresponding to the holes 34*a* to 34*d*.

First of all, the first portion 22 is connected to the element substrate 9, and the first portion 22 of the electric wiring substrate 11 is fixed to the first surface 10*a* via the adhesive agent 32 (see FIG. 2). The method of fixation of the first portion 22 will be described with reference to FIG. 4.

The bumps 18 of the element substrate 9 and the electrode terminal 30 of the electric wiring substrate 11 are electrically connected by using an inner lead bonding method. Specifically, in the state in which the bumps 18 and the electrode terminal 30 are in contact with each other, ultrasonic waves and heat are applied to a contact portion therebetween, so that metal joining between the bumps 18 and the electrode terminal 30 results.

When the bumps 18 and the electrode terminal 30 are connected, an adhesive agent 36 is filled into a gap between the element substrate 9 and the housing 10, and an adhesive agent 37 is applied onto the electrode terminal 30. When the adhesive agents 36 and 37 are solidified, a joint portion between the bumps 18 and the electrode terminal 30 is sealed with adhesive agents 36 and 37. Consequently, the joint portion is electrically insulated from the periphery.

When the first portion 22 is fixed to the first surface 10*a*, the second portion 23 is bent until the third portion 24 comes into contact with the housing 10 as illustrated in FIG. 3B. At this time, the projections 35*a* to 35*d* are inserted into the holes 34*a* to 34*d*. By crimping the projections 35*a* to 35*d* with heat, the third portion 24 is fixed to the second surface 10*b*.

In this embodiment, by crimping the projections 35*a* to 35*d*, the third portion 24 is fixed to the housing 10. However, the method of fixing the third portion 24 to the housing 10 is not limited to crimping. For example, the third portion 24 may be fixed to the housing 10 via the adhesive agent.

First Embodiment

Figure 5A:
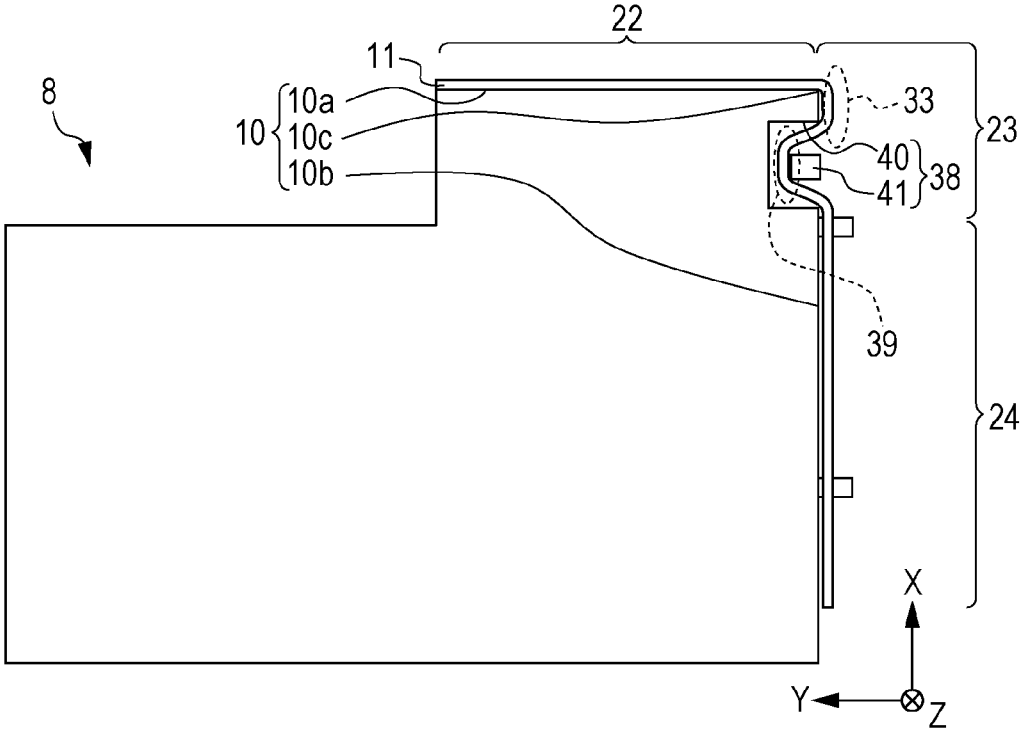
FIGS. 5A and 5B are a side view and a front view of the liquid ejection head according to a first embodiment of this disclosure.
Figure 5B:
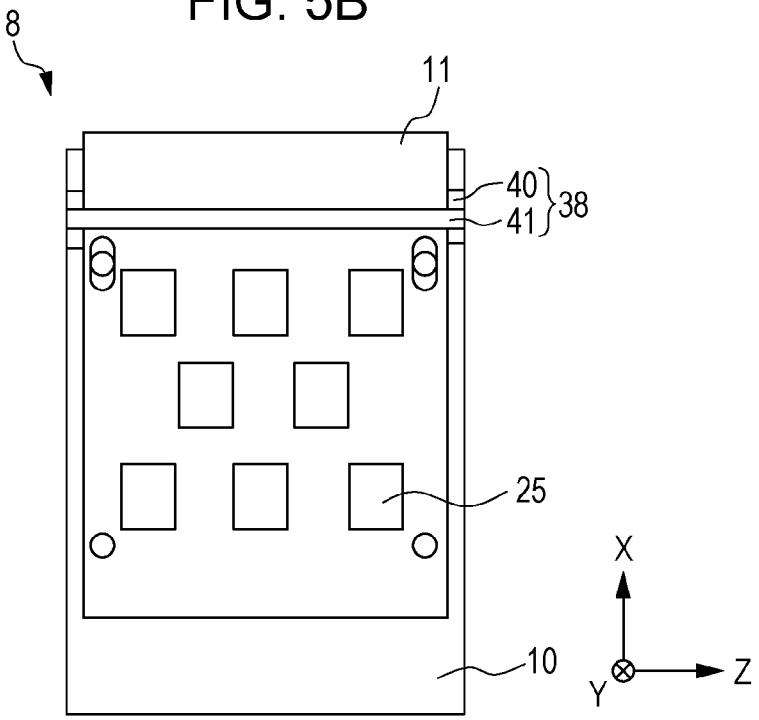

FIGS. 5A and 5B are a side view and a front view of the liquid ejection head according to a first embodiment of this disclosure.

As illustrated in FIGS. 5A and 5B, the liquid ejection head 8 of this embodiment is provided with a bent portion 38 where the second portion 23 is bent between the first bent portion 33 and the third portion 24. A second bent portion 39 formed by using the bent portion 38 is bent in a direction opposite to a direction in which the first bent portion 33 is bent.

In this embodiment, the bent portion 38 includes a depression 40 formed on the second surface 10*b* and an inner member 41 arranged in the interior of the depression at a distance from an inner side surface of the depression 40. The second bent portion 39 is formed by passing the second portion 23 through a gap between the inner side surface of the depression 40 and the inner member 41.

The inner member 41 is preferably on the second direction Y side with respect to the first bent portion 33.

According to this embodiment, since the bent portion 38 forms the second bent portion 39 at the second portion 23, sagging of the second portion 23 is reduced, and the first bent portion 33 may be reduced in size. Consequently, the dimensions of a peripheral portion of the element substrate 9 may be reduced, and the liquid ejection head 8 may be reduced in size.

Preferably, the second portion 23 is in contact with the inner member 41 at the second bent portion 39, and sags between the second bent portion 39 and the third portion 24. The inner member 41 comes into contact with the second portion 23, and hence a frictional force acts on the second portion 23, and sagging between the second bent portion 39 and the third portion 24 can hardly be transferred to the first bent portion 33. Consequently, the first bent portion 33 may further be reduced in size in the state in which the second portion 23 is further sagged.

In this embodiment, the inner member 41 extends from one end to the other end of the electric wiring substrate 11 relating to an orientation of the center axis of curvature Z of the second bent portion 39. Since a contact surface between the inner member 41 and the second portion 23 is further increased, the frictional force acting on the second portion 23 is further increased, and the first bent portion 33 can be reduced in size while the second portion 23 further sags.

Figure 6:
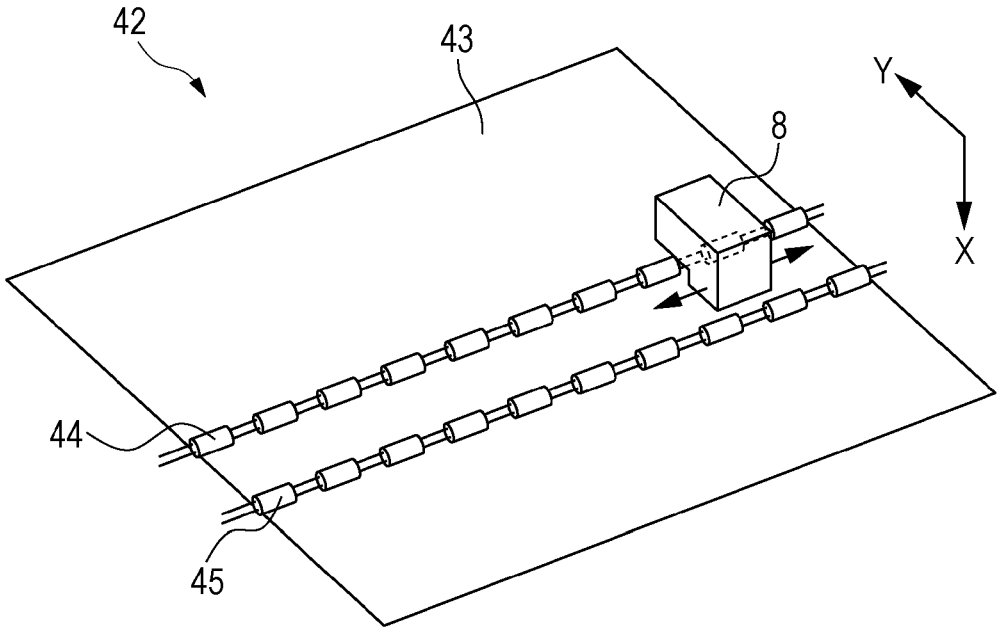
FIG. 6 is a schematic view of a liquid ejection apparatus provided with the liquid ejection head of this disclosure.

FIG. 6 is a schematic view of a liquid ejection apparatus 42 provided with the liquid ejection head 8. The liquid ejection apparatus 42 further includes press rollers 44 and 45 configured to press a recording medium 43 such as paper in the first direction X, and convey the recording medium 43 in the second direction Y. The liquid ejection head 8 ejects liquid toward the recording medium 43.

The press rollers 44 and 45 are arranged so as to interpose the first portion 22 (see FIGS. 5A and 5B) and the first bent portion 33 (see FIGS. 5A and 5B) therebetween in the second direction Y. Since paper press rollers 44 and 45*b* press the recording medium 43 desirably in the vicinity of the ejection port 19 (see FIG. 2), it is preferable that the press rollers 44 and 45 are provided in proximity to the liquid ejection head 8.

Figure 11A:
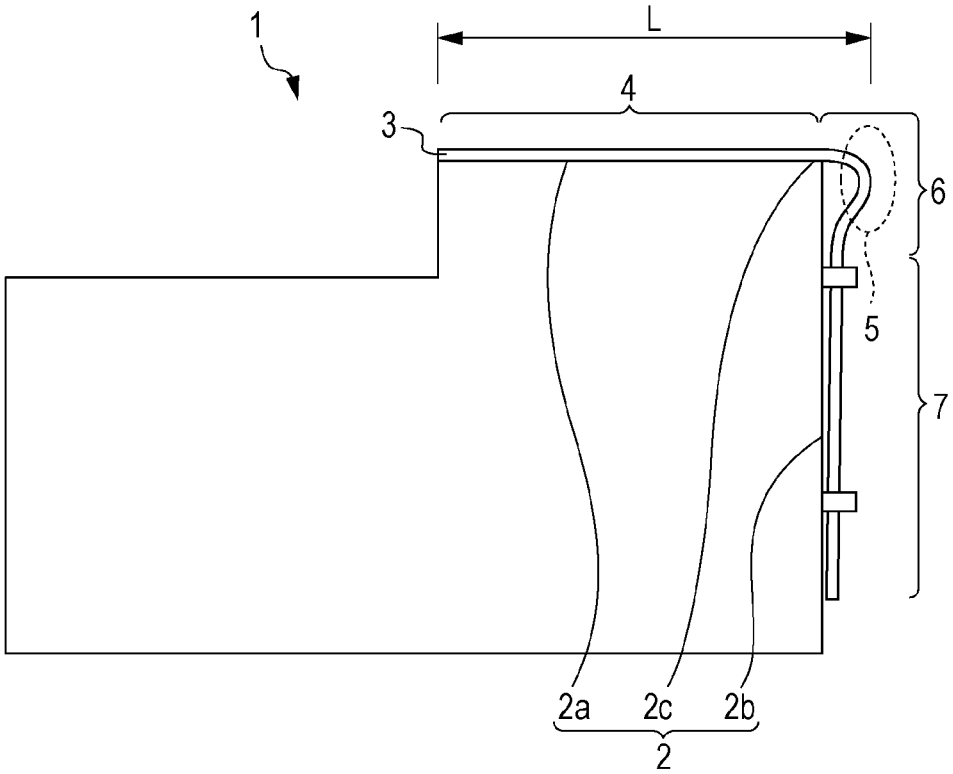
FIG. 11A Prior Art
FIGS. 11A and 11B are a side view and a front view of a related liquid ejection head.
Figure 11B:
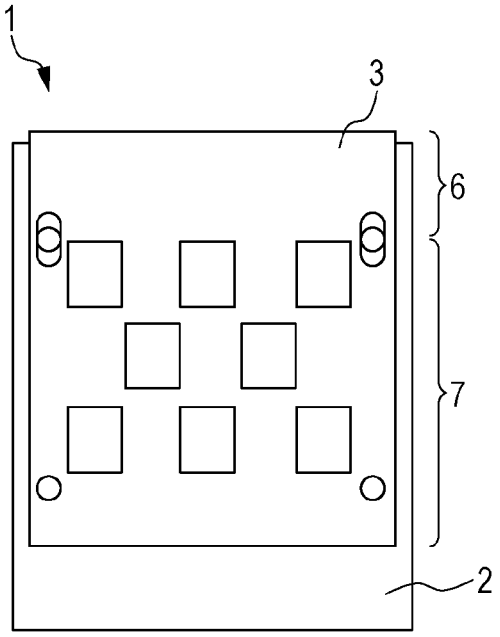
FIG. 11B Prior Art

If a dimension L of the liquid ejection head 8 (see FIG. 11A) is increased, the distance between the press rollers 44 and 45 is required to be increased. If the distance between the press rollers 44 and 45 is increased, an effect of the press rollers 44 and 45 pressing the recording medium 43 is lowered, and hence problems such as a printing failure or a paper jam may result.

In particular, when the recording medium 43 enters a space below the liquid ejection head 8 at the time of paper feeding, a paper jam occurs often because the recording medium 43 is not desirably pressed. In addition, in the generally compact liquid ejection apparatus 42, the dimension of an ejection port row in the longitudinal direction, that is, in the second direction Y tends to be increased in association with a speeding up of a liquid ejecting operation. The distance between the press rollers 44 and 45 is further increased due to an increase in the size of the first bent portion 33.

In this embodiment, since the dimension of the first bent portion 33 (see FIGS. 5A and 5B) is reduced, the distance between the press rollers 44 and 45 may be reduced. Consequently, conveyance failures such as clogging of the recording medium 43 or rubbing of the recording medium 43 can be restrained.

Subsequently, a method of manufacturing the liquid ejection head 8 will be described.

Referring to FIGS. 5A and 5B again, when the first portion 22 is fixed to the first surface 10*a*, the first bent portion 33 is formed on the second portion 23. At this time, the second portion 23 sags.

The third portion 24 and the second portion 23 are passed through the gap between the inner side surface of the depression 40 and the inner member 41. The third portion 24 is pulled out from the depression 40, and is fixed to the second surface 10*b*.

With the third portion 24 pulled out from the depression 40, the second portion 23 comes into contact with the inner member 41 between the first bent portion 33 and the third portion 24. Consequently, the second portion is bent in a direction opposite to the direction in which the first bent portion 33 is bent.

According to the manufacturing method of this embodiment, since the second bent portion 39 is formed, the sagging amount of the second portion 23 may be reduced without pulling the second portion 23 with a relatively strong force. Consequently, the first bent portion 33 is reduced in size, and hence the liquid ejection head 8 may be reduced in size.

Since the second portion 23 is not pulled a relatively strong force, the likelihood of the electric wiring substrate 11 being damaged at the time of manufacture may be reduced.

Figure 7:
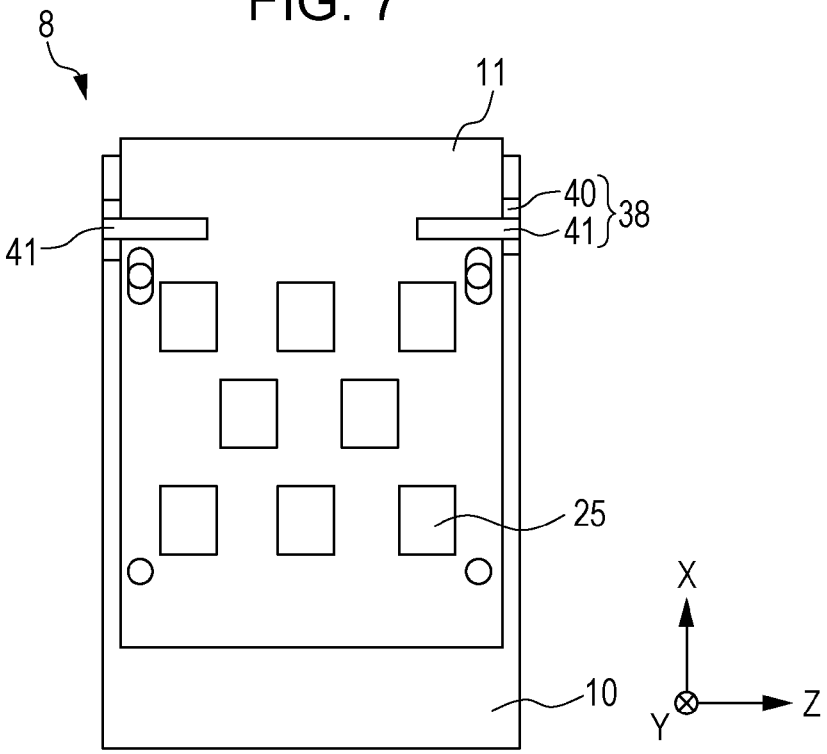
FIG. 7 is a front view illustrating a modification of the first embodiment.

FIG. 7 is a front view illustrating a modification of the liquid ejection head 8 of this embodiment. As illustrated in FIG. 7, the inner member 41 may be divided in the direction of center axis of curvature Z of the second bent portion 39. In the example illustrated in FIG. 7, since the operator can insert his or her hand or a tool in an area where the inner member 41 is divided, the third portion 24 and the second portion 23 can be passed through the gap between the inner side surface of the depression 40 and the inner member 41 more easily.

The housing 10 and the inner member 41 may be formed integrally or separately. The number of the element substrates 9 is not limited to one, but the liquid ejection head 8 may be provided with a plurality of the element substrates 9. The housing 10 is not limited to the integrally formed member, and may be formed by combining a plurality of members.

Second Embodiment

Figure 8A:
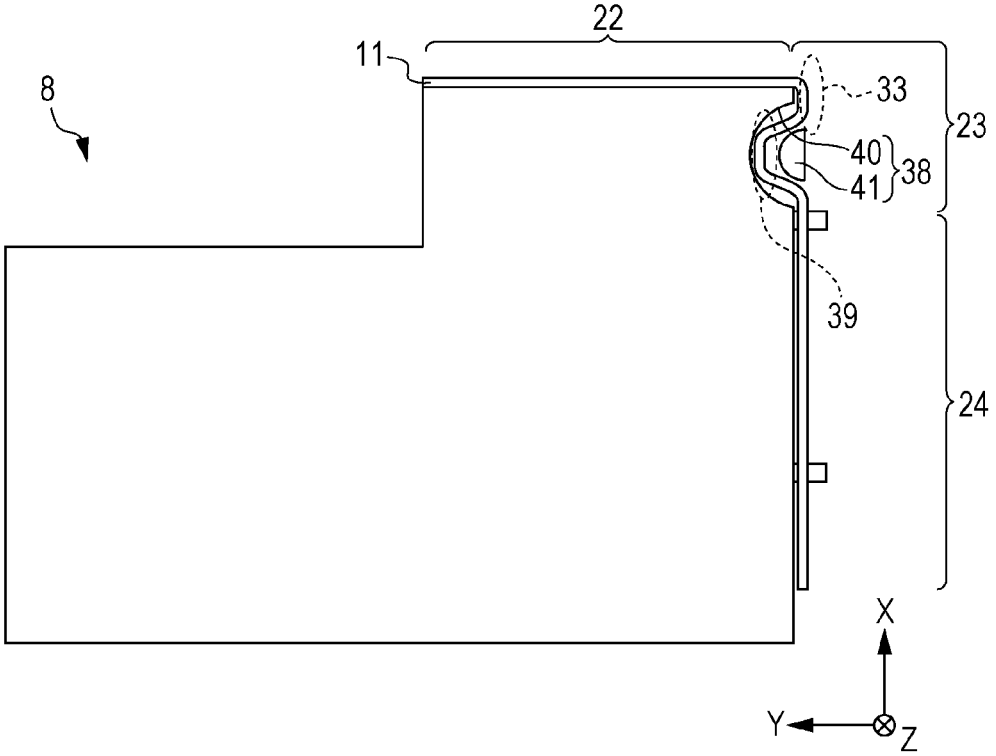
FIGS. 8A and 8B are a side view and a front view of the liquid ejection head according to a second embodiment of this disclosure.
Figure 8B:
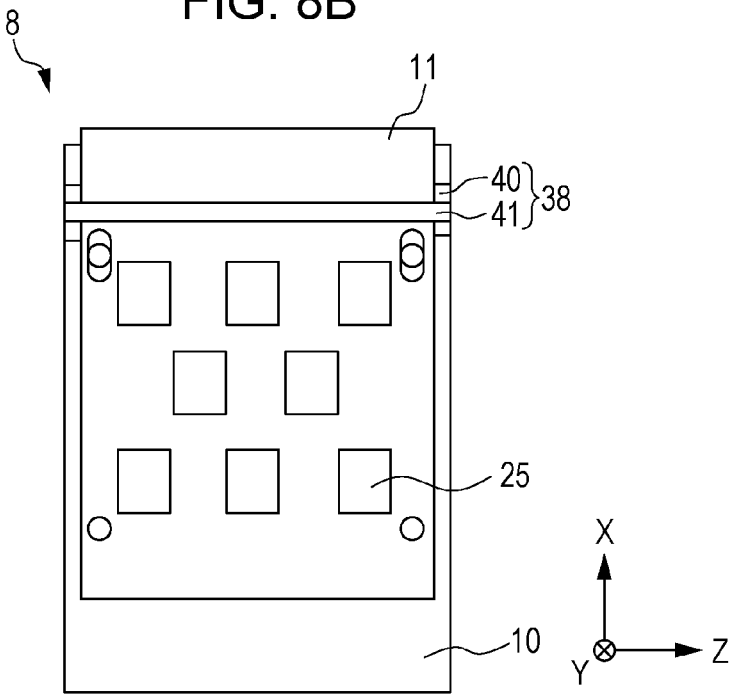

FIGS. 8A and 8B are a side view and a front view of the liquid ejection head according to a second embodiment of this disclosure. Same components as in the first embodiment are denoted by the same reference numerals and description thereof is omitted.

As illustrated in FIGS. 8A and 8B, in the liquid ejection head 8 of this embodiment, the depression 40 has a semicircular shape in a cross section intersecting the direction of center axis of curvature Z. The inner member 41 has a semicircular shape in a cross section intersecting the direction of center axis of curvature Z, and an arcuate portion faces the inner side surface of the depression 40.

Here, a process of passing the electric wiring substrate 11 through the gap between the inner side surface of the depression 40 and the inner member 41 will be described with reference to FIGS. 9A to 9C.

Figure 9A:
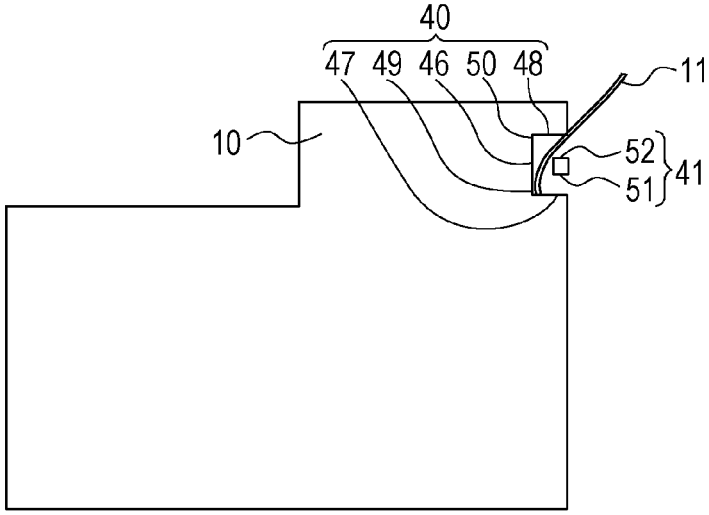
FIGS. 9A to 9C are drawings for explaining a process of passing the electric wiring substrate through a bent portion.

FIG. 9A is a drawing for explaining the process of passing the electric wiring substrate 11 through the gap between the inner side surface of the depression 40 and the inner member 41 in the liquid ejection head 8 (see FIGS. 5A and 5B) of the first embodiment. FIG. 9B is a drawing for explaining the process of passing the electric wiring substrate 11 through the gap between the inner side surface of the depression 40 and the inner member 41 in the liquid ejection head 8 (see FIGS. 8A and 8B) of the second embodiment.

The depression 40 includes a bottom wall 46, a first side wall 47 positioned on the side where the third portion 24 is pulled out, and a second side wall 48 positioned on a side where the third portion 24 is inserted. The depression 40 includes a first corner portion 49 formed by the bottom wall 46 and the first side wall 47, and a second corner portion 50 formed by the bottom wall 46 and the second side wall 48.

In the liquid ejection head 1 illustrated in FIG. 9A, the first corner portion 49 is angular. The second corner portion 50 is also angular. Therefore, a distal end of the electric wiring substrate 11 can easily be caught by the first and second corner portions 49 and 50, so that the electric wiring substrate 11 cannot be pulled out easily.

The inner member 41 includes a first end portion 51 positioned on the depression 40 side and positioned on the side where the third portion 24 is pulled out, and a second end portion 52 positioned on the depression 40 side and positioned on the side where the third portion 24 is inserted. The first and second end portions 51 and 52 are angular. Therefore, the electric wiring substrate 11 can easily be caught by the first and second end portions 51 and 52, so that the electric wiring substrate 11 may become damaged when being pulled out from the depression 40.

Figure 9B:
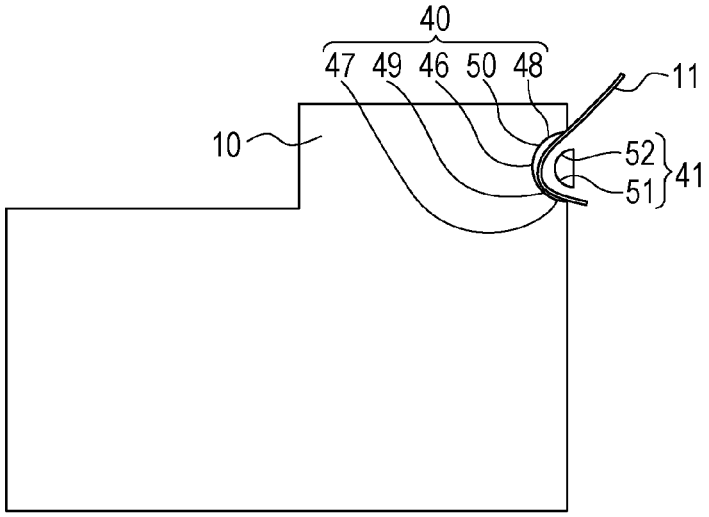

In this embodiment, as illustrated in FIG. 9B, the first and second corner portions 49 and 50 are round. Therefore, the distal end of the electric wiring substrate 11 cannot easily be caught by the inner side surface of the depression 40, so that the electric wiring substrate 11 can easily be pulled out from the depression 40.

The first and second end portions 51 and 52 are round. Therefore, the electric wiring substrate 11 cannot easily be caught by the first and second end portions 51 and 52, so that the electric wiring substrate 11 cannot become damaged when the electric wiring substrate 11 is pulled out from the depression 40.

In this manner, according to this embodiment, the electric wiring substrate 11 can easily be passed through the gap between the inner side surface of the depression 40 and the inner member 41.

As long as at least one of the first and second corner portions 49 and 50 is round, the distal end of the electric wiring substrate 11 cannot be easily caught by the inner side surface of the depression 40 in comparison with the first embodiment. As long as at least one of the first and second end portions 51 and 52 is round, the electric wiring substrate 11 cannot become damaged easily when the electric wiring substrate 11 is pulled out from the depression 40 in comparison with the first embodiment.

In the same manner as the liquid ejection head 8 of the first embodiment, the liquid ejection head 8 can be reduced in size while sagging the electric wiring substrate 11 having flexibility in the liquid ejection head 8 of this embodiment as well. In the liquid ejection apparatus 42 (see FIG. 6) provided with the liquid ejection head 8 of this embodiment, conveyance failures such as clogging of the recording medium 43 and rubbing of the recording medium 43 can be restrained.

The inner member 41 may be divided in the direction of center axis of curvature Z of the second bent portion 39 (see FIG. 7). In this case, the electric wiring substrate 11 can easily be passed through the gap between the inner side surface of the depression 40 and the inner member 41.

The housing 10 and the inner member 41 may be formed integrally or separately. The number of the element substrates 9 is not limited to one, but the liquid ejection head 8 may be provided with the plurality of element substrates 9. The housing 10 is not limited to the integrally formed member, and may be formed by combining a plurality of members.

Third Embodiment

Figure 10A:
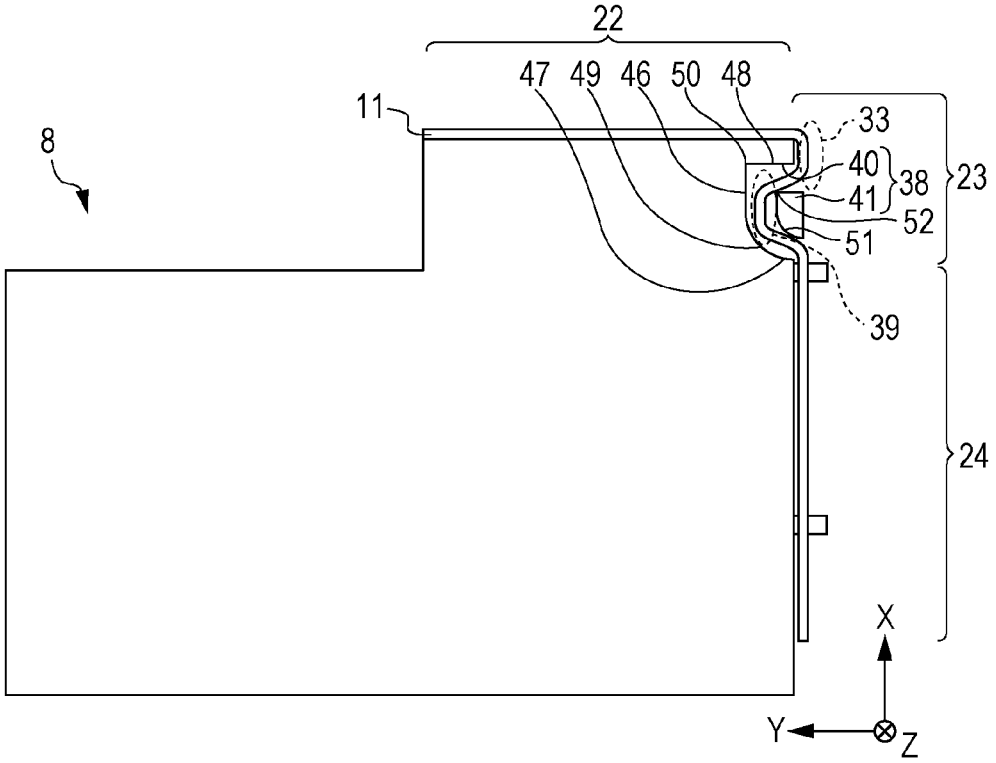
FIGS. 10A and 10B are a side view and a front view of the liquid ejection head according to a third embodiment of this disclosure.
Figure 10B:
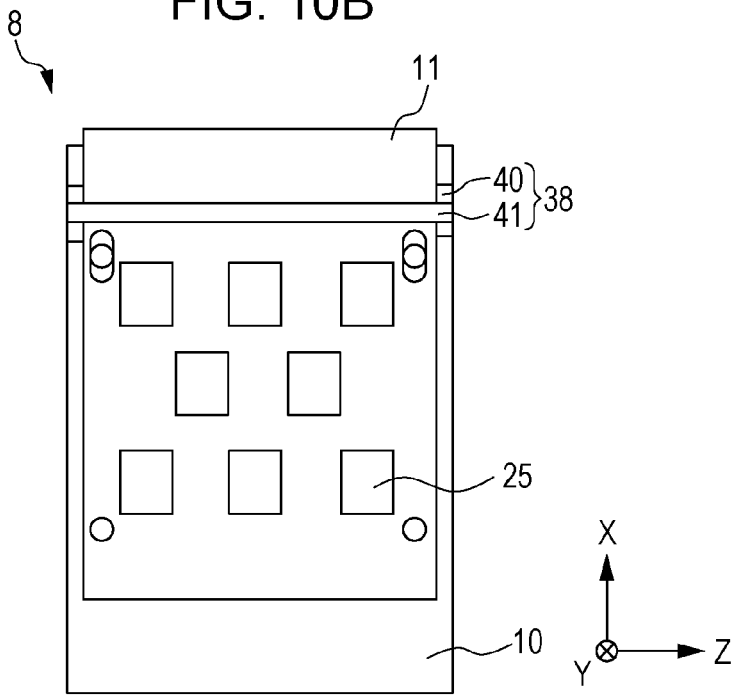

FIGS. 10A and 10B are a side view and a front view of the liquid ejection head according to a third embodiment of this disclosure. Same components as in the first embodiment are denoted by the same reference numerals and description thereof is omitted.

As illustrated in FIGS. 10A and 10B, the first corner portion 49 of the depression 40 is round and the second corner portion 50 of the depression 40 is angular. The first end portion 51 of the inner member 41 is round and the second end portion 52 of the inner member 41 is angular.

Here, a process of passing the electric wiring substrate 11 through the gap between the inner side surface of the depression 40 and the inner member 41 will be described with reference to FIGS. 9A to 9C.

Figure 9C:
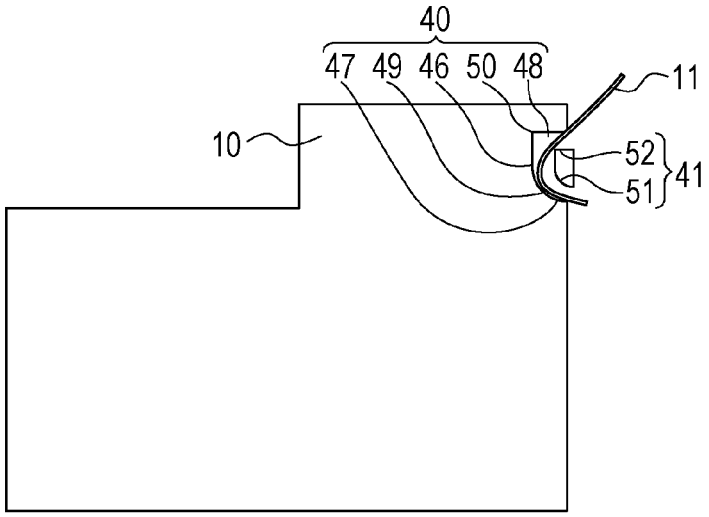

FIG. 9C is a drawing for explaining the process of passing the electric wiring substrate 11 through the gap between the inner side surface of the depression 40 and the inner member 41 in the liquid ejection head 8 (see FIGS. 10A and 10B) of the third embodiment.

In this embodiment, the first corner portion 49 of the depression 40 is round. Therefore, the distal end of the electric wiring substrate 11 cannot easily be caught by first corner portion 49, so that the electric wiring substrate 11 can easily be pulled out from the depression 40.

The first end portion 51 of the inner member 41 is round. Therefore, the electric wiring substrate 11 cannot easily be caught by the first end portion 51, so that the electric wiring substrate 11 cannot become damaged when the electric wiring substrate 11 is pulled out from the depression 40.

In the state in which the electric wiring substrate 11 having flexibility is bent, a tensile force in a direction in which the first bent portion 33 increases in side acts on the electric wiring substrate 11 because of a restoration force generated in the first bent portion 33. In the liquid ejection head 8 (see FIGS. 8A and 8B and FIG. 9B) of the second embodiment, the inner member 41 is positioned on the bottom wall side of the depression 40 and is round at an end portion positioned on the first bent portion 33 side, so that the electric wiring substrate 11 can hardly be caught by the end portion. Therefore, the electric wiring substrate 11 can easily slip on the end portion, so that the first bent portion 33 tends to be increased in size.

In the liquid ejection head 8 of this embodiment, the liquid ejection head 8 (see FIG. 9C and FIGS. 10A and 10B), since the inner member 41 is angular at the second end portion 52, the electric wiring substrate 11 can easily be caught by the second end portion 52. Therefore, the electric wiring substrate 11 can hardly slip on the second end portion 52, so that an increase in size of the first bent portion 33 is prevented.

In other words, this embodiment has a structure in which the electric wiring substrate 11 can easily be passed through the gap between the inner side surface of the depression 40 and the inner member 41 and, in the state in which the electric wiring substrate 11 has completely passed through the gap, the electric wiring substrate 11 can hardly be returned backward.

This embodiment is not limited to a mode in which the inner member 41 is angular at the second end portion 52. This embodiment may have a mode in which the second end portion 52 has a round form having a radius of curvature smaller than a radius of curvature of a round portion of the first end portion 51.

This embodiment is not limited to a mode in which the depression 40 is angular at the second corner portion 50. This embodiment may have a mode in which the second corner portion 50 has a round form having a radius of curvature smaller than a radius of curvature of a round portion of the first corner portion 49.

In the same manner as the liquid ejection head 8 of the first embodiment, the liquid ejection head 8 may be reduced in size without causing damage of the electric wiring substrate having flexibility in the liquid ejection head 8 of this embodiment as well. In the liquid ejection apparatus 42 (see FIG. 6) provided with the liquid ejection head 8 of this embodiment, conveyance failures such as clogging of the recording medium 43 and rubbing of the recording medium 43 can be restrained.

The inner member 41 may be divided in the direction of center axis of curvature Z of the second bent portion 39 (see FIG. 7). In this case, the electric wiring substrate 11 can easily be passed through the gap between the inner side surface of the depression 40 and the inner member 41.

The housing 10 and the inner member 41 may be formed integrally or separately. The number of the element substrates 9 is not limited to one, but the liquid ejection head 8 may be provided with the plurality of element substrates 9. The housing 10 is not limited to the integrally formed member, and may be formed by combining a plurality of members.

According to this disclosure, the liquid ejection head can be reduced in size while sagging the electric wiring substrate having flexibility.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-013138, filed Jan. 28, 2014, which is hereby incorporated by reference herein in its entirety.

What is claimed is:

1. A liquid ejection head comprising:

a recording element substrate provided with an element configured to generate energy used for ejecting liquid;

an electric wiring substrate including a bent portion, a connecting portion provided on one side of the bent portion and connected with the recording element substrate, and an input portion provided on the other side of the bent portion and configured to receive an input of a signal to be supplied to the recording element substrate; and a housing including a first surface configured to support one side of the electric wiring substrate, a second surface configured to support the other side of the electric wiring substrate, a depression provided on the second surface, and a inner member separated from a bottom surface of the depression and extending into an opening of the depression, wherein a part of the other side of the electric wiring substrate is disposed between the bottom surface of the depression and the inner member.

2. The liquid ejection head according to claim 1, wherein the electric wiring substrate is in contact with the member.

3. The liquid ejection head according to claim 2, wherein a contact portion between the electric wiring substrate and the member is provided between the bent portion and the input portion.

4. The liquid ejection head according to claim 1, wherein the electric wiring substrate is separated from the bottom surface of the depression.

5. A liquid ejection device comprising:

a liquid ejection head according to claim 1 configured to eject a liquid toward the recording medium; and a plurality of press rollers configured to press the recording medium in a first direction in which the liquid is ejected and convey the recording medium in a second direction intersecting the first direction, wherein the first portion and the first bent portion are arranged in the second direction, and the plurality of press rollers are arranged so as to interpose the first portion and the first bent portion therebetween in the second direction.

6. A liquid ejection head comprising:

an element substrate configured to eject a liquid;

a housing that includes a first surface, a second surface intersecting the first surface, and a corner portion formed by the first and second surfaces intersecting each other, and that supports the element substrate on the first surface; and an electric wiring substrate having flexibility and including: a first portion supported on the first surface; a second portion including a first bent portion formed by being bent at the corner portion; a third portion supported on the second surface; and a second bent portion formed on the second portion between the first bent portion and the third portion, wherein the housing includes a depression formed on the second surface and an inner member arranged in the interior of the depression at a distance from an inner side surface of the depression, and wherein the second bent portion is formed by passing the second portion through a gap between the inner side surface of the depression and the inner member.

7. The liquid ejection head according to claim 6, wherein the depression includes a bottom wall, a first side wall positioned on the third portion side; a second side wall positioned on the first bent portion side; a first corner portion formed by the bottom wall and the first side wall; and a second corner portion formed by the bottom wall and the second side wall, and at least one of the first and second corner portions is round.

8. The liquid ejection head according to claim 7, wherein the inner member includes a first end portion positioned on the depression side and positioned on the third portion side; and a second end portion positioned on the depression side and positioned on the first bent portion side, and at least one of the first and second end portions is round.

9. The liquid ejection head according to claim 6, wherein the first end portion is round, and the second end portion is angular, or is round having a radius of curvature smaller than a radius of curvature of a round portion of the first end portion.

10. The liquid ejection head according to claim 6, wherein the inner member extends from one end to the other end of the electric wiring substrate relating to a direction of a center axis of curvature of the second bent portion.

11. The liquid ejection head according to claim 6, wherein the inner member is divided in the direction of the center axis of curvature of the second bent portion.

12. A method of manufacturing a liquid ejection head comprising:

a step of preparing an element substrate configured to eject a liquid, a housing, an electric wiring substrate having flexibility and including first, second, and third portions arranged in this order; a bent portion configured to bend the electric wiring substrate, the housing including a first surface, a second surface intersecting the first surface, and a corner portion formed by intersection of the first and second surfaces, and supporting the element substrate on the first surface;

a first fixing step for fixing the first portion to the first surface;

a bending step for bending the second portion by the corner portion to form a first bent portion at the second portion and bending the second portion between the first bending portion and the third portion by using the bent portion to form a second bent portion at the second portion; and a second fixing step for fixing the third portion to the second surface, wherein the bent portion includes a depression formed on the second surface and an inner member arranged in the interior of the depression at a distance from an inner side surface of the depression, and wherein the second bent portion is formed by passing the second portion through a gap between the inner side surface of the depression and the inner member in the second bending step.

13. The method of manufacturing a liquid ejection head according to claim 12, wherein the depression includes a bottom wall, a first side wall positioned on a side where the second portion is pulled out, a second side wall positioned on a side where the second portion is inserted, a first corner portion formed by the bottom wall and the first side wall, and a second corner portion formed by the bottom wall and the second side wall, and at least one of the first and second corner portions is round.

14. The method of manufacturing a liquid ejection head according to claim 12, wherein the inner side member includes a first end portion positioned on the depression side and positioned on the side where the second portion is pulled out, and a second end portion positioned on the depression side and positioned on the side where the second portion is inserted, and at least one of the first and second end portions is round.

15. The method of manufacturing a liquid ejection head according to claim 14, wherein the first end portion is round, and the second end portion is angular, or is round having a radius of curvature smaller than a radius of curvature of a round portion of the first end portion.

16. The method of manufacturing a liquid ejection head according to claim 12, wherein the inner member extends from one end to the other end of the electric wiring substrate relating to a direction of a center axis of curvature of the second bent portion.

17. The method of manufacturing a liquid ejection head according to claim 12, wherein the inner member is divided in a direction of a center axis of curvature of the second bent portion.

* * * * *